United States Patent [19]

Focke et al.

[11] Patent Number: 4,570,421

[45] Date of Patent: Feb. 18, 1986

[54] PROCESS AND APPARATUS FOR CLOSING CARTONS

[75] Inventors: Heinz Focke, Verden; Hugo Mutschall, Kirchlinteln, both of Fed. Rep. of Germany

[73] Assignee: Focke & Co., Verden, Fed. Rep. of Germany

[21] Appl. No.: 563,920

[22] Filed: Dec. 21, 1983

[30] Foreign Application Priority Data

Jan. 15, 1983 [DE] Fed. Rep. of Germany ..... 3301237

[51] Int. Cl.[4] ..... B65B 7/20; B65B 51/02; B31B 1/36; B31B 1/76

[52] U.S. Cl. ..... 53/491; 53/374; 53/382; 53/383; 493/177; 493/178; 493/183

[58] Field of Search ..... 53/228, 229, 230, 231, 53/242, 374, 375, 381 R, 382, 383, 491, 564, 565; 493/177, 178, 179, 183, 453

[56] References Cited

U.S. PATENT DOCUMENTS 3,959,950 6/1976 Fukuda ..... 53/374
4,479,345 10/1984 Nord ..... 53/383

*Primary Examiner*—Robert L. Spruill
*Assistant Examiner*—Richard Mudd
*Attorney, Agent, or Firm*—Sughrue, Mion, Zinn, Macpeak & Seas

[57] ABSTRACT

For filling and closing cartons, the latter are filled via the open bottom and then conveyed along an angular transport track. Fixed folding means for folding inner tabs (15 to 18) and outer tabs (19 to 22) solely as a result of the relative movement of the carton are located in the region of two conveying stages (42, 62). In the region of the second conveying stage (62), the carton has a relative position which has turned through 180°.

9 Claims, 8 Drawing Figures

PROCESS AND APPARATUS FOR CLOSING CARTONS

DESCRIPTION

Figures 1A, 1B, 1C, 1D:
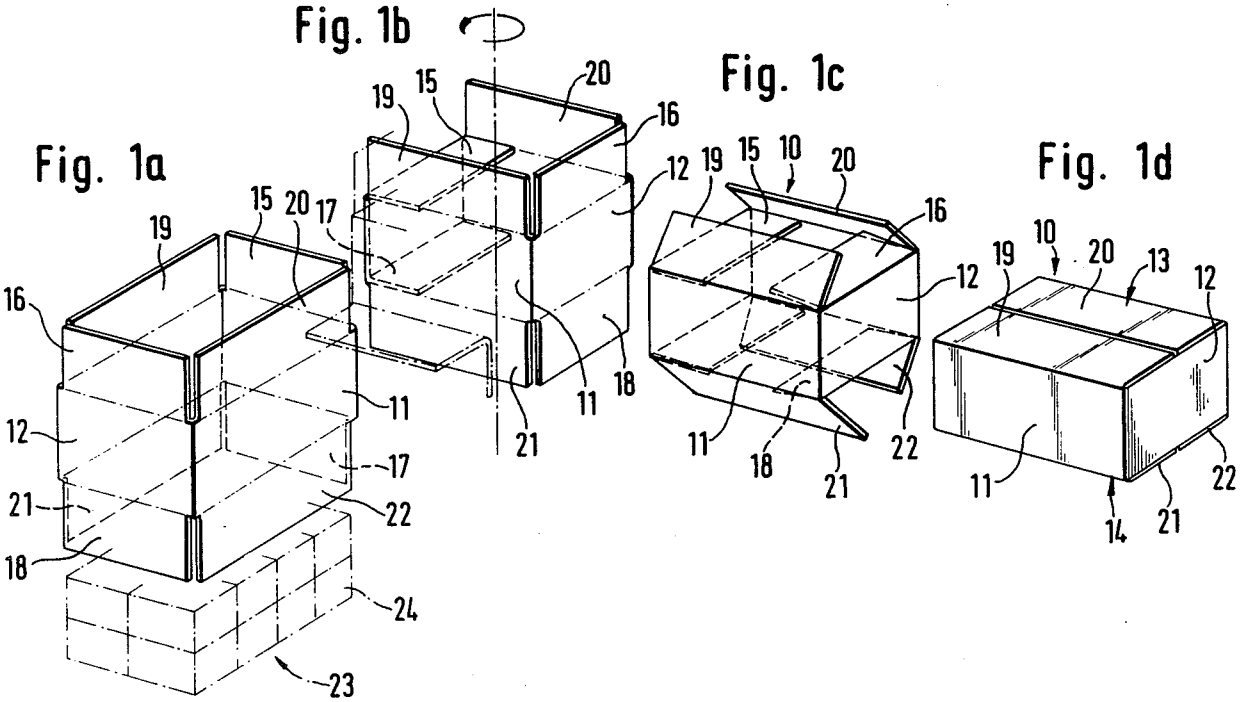

The invention relates to a process for closing cartons with side walls and with an upper wall and bottom wall formed from inner and outer tabs, in which the (upper and lower) inner and outer tabs can be folded over from an initial position in the plane of the side walls into the plane of the upper and lower wall respectively. The invention also relates to an apparatus for closing cartons of this type by using the process mentioned above.

The production, in particular the filling and closing of relatively large-volume cartons, mainly consisting of cardboard or corrugated cardboard, makes special demands on packaging technology because, as a rule, large masses have to be moved relatively quickly. In order, nevertheless, to achieve high outputs and carry out the necessary folding steps by means of simple cycles of movement . . . Conventionally, cartons of this type are also filled within the packaging machines used for them (carton packers), specifically being filled mainly with a group of individual articles (groups of small packs). Filling the open cartons via the bottom has proved appropriate here (U.S. Pat. No. 3,748,813).

The cartons are conventionally constructed so that the vertical side walls form a structure which is closed as a result of the prefabrication of the carton. The upper wall and bottom wall are formed by several, usually four, tabs (inner tabs and outer tabs) which are folded in succession into the plane of the upper wall and bottom wall.

In the known carton packer according to U.S. Pat. No. 3,748,813, the cartons are filled from the open bottom. Subsequently, the upper and lower inner tabs are folded over by movable folding means. The outer tabs are then folded, that is to say after the partially folded carton has been pushed off from the platform. Because of the movable folding means, this carton packer is susceptible to faults, involves a high outlay and is not very efficient.

The object on which the invention is based is to propose a process for producing (filling and closing) cartons and a packaging machine suitable for carrying out the process, by means of which, in particular, the closing operation for the cartons is considerably simplified, in such a way that a higher output can be achieved, whilst ensuring a simpler design of the apparatus which is less susceptible to faults.

To achieve this object, the process according to the invention for closing cartons is defined by the following features:

(a) The inner and outer tabs for forming the upper wall and bottom wall are folded (exclusively) as a result of the movement of the carton relative to fixed immovable folding means, (b) The upper and lower inner tabs located at the front in the direction of transport are folded first, (c) The opposite upper and lower inner tabs are then folded as a result of the further transport of the carton in the opposite direction, (d) The upper and lower outer tabs are subsequently folded as a result of the continuation of the transport movement of the carton in an unchanged direction.

By means of the process according to the invention, it is possible to fold the tabs forming the upper wall and bottom wall exclusively by fixed folding means constructed without movable parts, specifically as a result of the relative movement of the carton along extremely short paths of movement. The carton packer is consequently efficient, simple and not very susceptible to faults. Furthermore, a considerable reduction in noise is achieved because there are no movable folding means.

After the upper and lower inner tabs, initially located at the front in the direction of transport, have been folded, according to a further proposal of the invention, the carton is rotated, specifically preferably through 90°, and then transported further in a direction of movement at an angle of 90° relative to the previous direction of movement, in such a way that the initially unfolded upper and lower inner tabs point forwards in the direction of transport, for the purpose of folding. The inner tabs can be folded in a manner which is staggered in time or space.

The apparatus according to the invention for closing cartons of this type is defined by fixed folding means (upper folder, lower folder) located above and below the path of movement of the cartons, for folding over the upper and lower inner tabs, located at the front in the direction of transport, as a result of the movement of the carton relative to the folding means.

In the initial position, the carton, with upper and lower inner and outer tabs extending in vertical planes, and including the carton content, is located on a (liftable and lowerable) platform. Because the carton is pushed off from this onto a table (rotatable about a vertical axis), the two inner tabs located at the front in the direction of transport are folded over by fixed folding means. The opposite upper and lower inner tabs are folded as a result of a subsequent stage of transport of the carton after the latter has previously been rotated, the respective upper and lower inner tabs now being located at the front in the direction of transport. According to the invention, this change in the relative position of the carton of 180° altogether is obtained, on the one hand, as a result of rotation of the carton (by means of the table) through 90° and, furthermore, as a result of a change in the direction of transport, again of 90°. By being pushed off from the table, the carton is transferred to a discharge-conveyor track which is at the same time a folding means for the lower inner tab and which subsequently has folding means (folding switchpoints) for the outer tabs. After passing these, the carton is closed completely.

Figure 2:
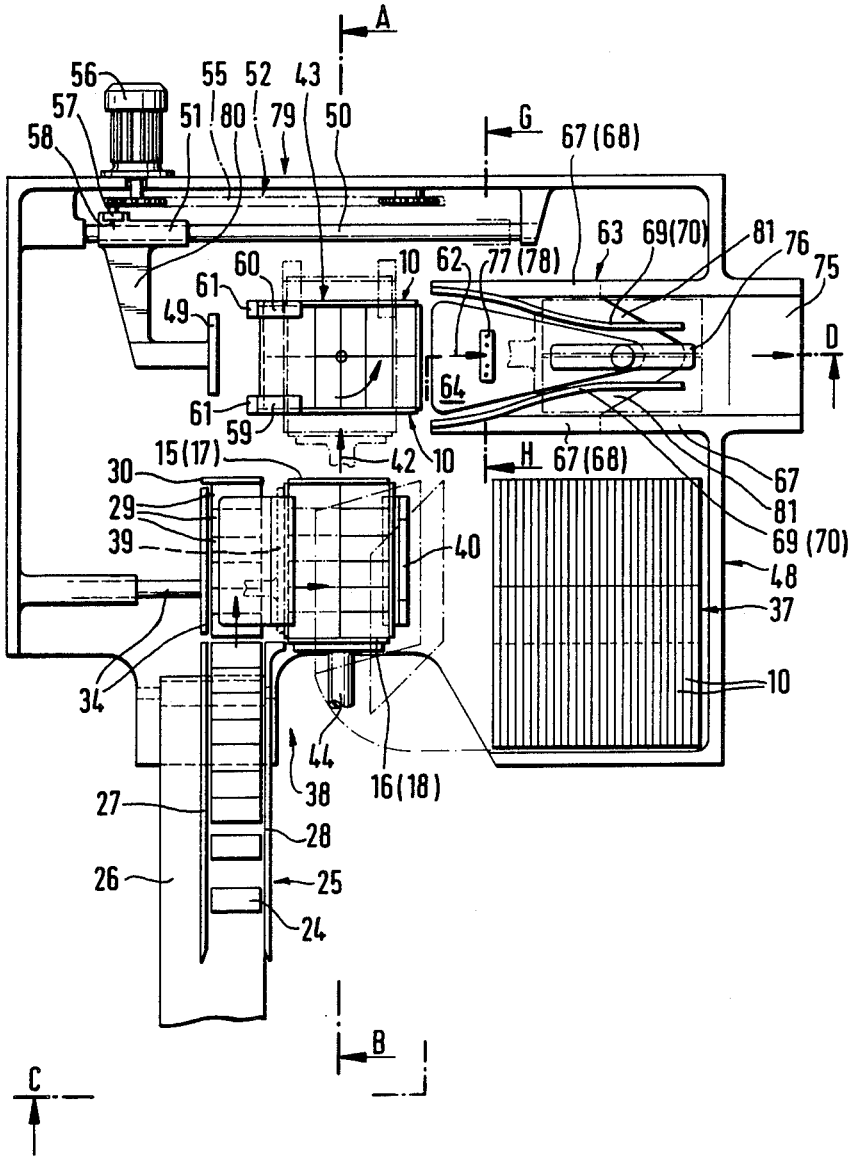
Figure 3:
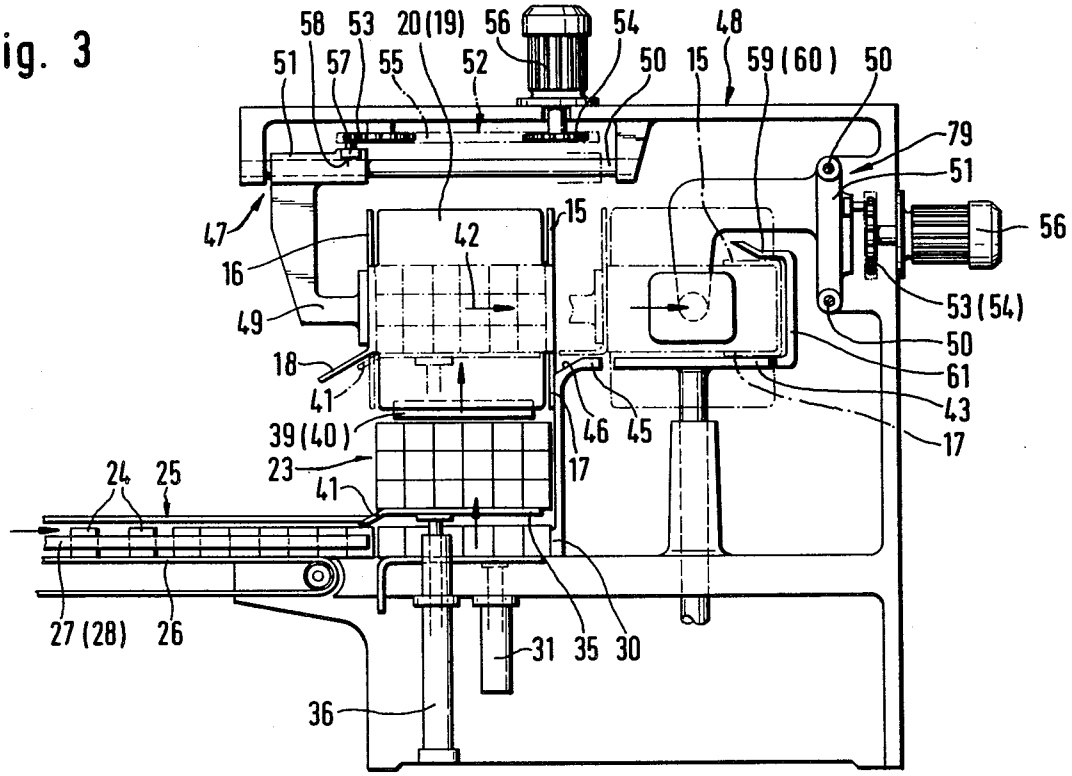
Figure 4:
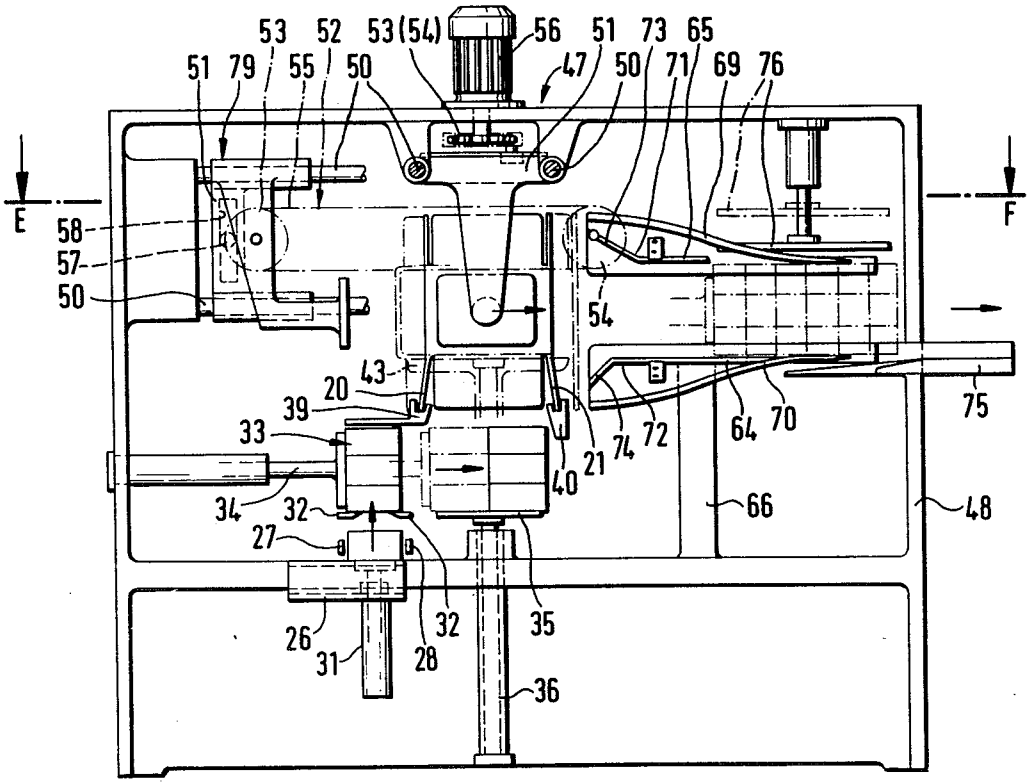
Figure 5:
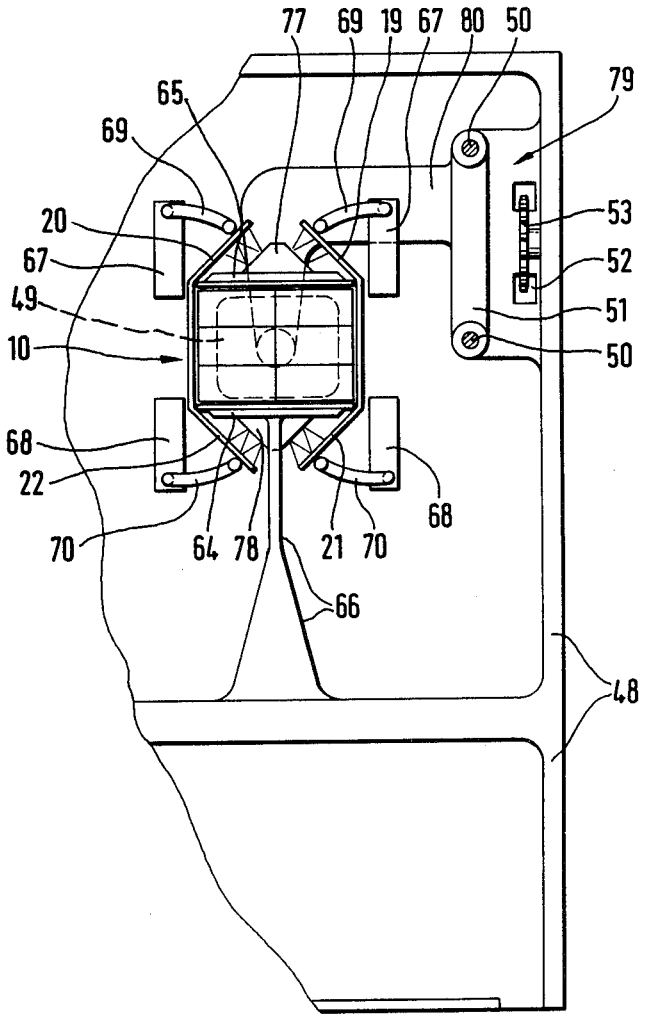

Further features of the invention relate to the design and arrangement of the folding means, to the conveying devices and to gluing means for the tabs to be folded. The process and an exemplary embodiment of the apparatus are explained in more detail below with reference to the drawings in which:

FIGS. 1*a* to 1*d* show a carton in the various folding and closing phases in a perspective representation, FIG. 2 shows an apparatus for filling and closing a carton according to FIGS. 1*a* to 1*d* in a simplified plan view (the section plane E-F in FIG. 4), FIG. 3 shows a partial view of the apparatus according to FIG. 2 in a viewing plane A-B, FIG. 4 shows a partial view of the apparatus according to FIG. 2 in a viewing plane C-D, FIG. 5 shows a detail (the gluing device) of the apparatus in a vertical viewing plane G-H of FIG. 2.

The present exemplary embodiment relates to the packaging treatment of cartons 10 having the features of FIGS. 1*a* to 1*d*. According to these, the carton 10 is formed from (vertical) side walls, namely longitudinal walls 11 and end walls 12. An upper wall 13 and a lower wall 14 consist of folding tabs, namely upper inner tabs 15 and 16 and lower inner tabs 17 and 18. These are first folded into the plane of the upper wall 13 and lower wall 14 respectively. Upper outer tabs 19, 20 and lower outer tabs 21, 22 form the outer cover. The above-mentioned inner tabs 15 to 18 and outer tabs 19 to 22 adjoin adjacent side walls (longitudinal walls 11 or end walls 12). In the initial position according to FIG. 1*a*, with the carton 10 completely open, the inner tabs and outer tabs extend in the (vertical) planes of the side walls.

The carton 10 serves, here, for receiving a group 23 of small packs 24. This is introduced from below into the open carton, in such a way that the space enclosed by the side walls 11 and 12 is filled.

As a result of displacement in a first direction, namely into a position according to FIG. 1*b*, the upper and lower inner tabs 15 and 17 located at the front in the direction of movement are folded over into the plane of the upper wall 13 and lower wall 14. In the position according to FIG. 1*b*, the carton 10 is then rotated through 90° about a vertical axis. The carton is then transported further in a direction at an angle of 90° relative to the conveying direction described. As a result, the upper and lower inner tabs 16 and 18, which were originally at the rear, are located at the front. They are likewise folded over as a result of the further transport of the carton 10. Moreover, during this phase of movement, and subsequent to the inner tabs 16 and 18, the upper and lower outer tabs 19 to 22 are folded, so that in the position according to FIG. 1*d* the carton 10 is closed on all sides.

The apparatus for carrying out the filling and folding operations incorporates a feed-conveyor track 25 for individual small packs 24 which are delivered at (irregular) distances from one another. The feed-conveyor track consists of a conveyor belt 26 and (adjustable) track limitations 27, 28, between which the small packs 24 are conveyed.

A row 29 of these small packs 24 is collected in front of a stop 30. The row 29 is held on a lifter 31 movable up and down and, after the row 29 has been completed, is lifted by this (see especially FIG. 3) and deposited on lateral supporting strips 32 movable in a horizontal plane. The supporting strips 32 acting on a higher plane are designed in a known way and can be moved apart from one another and towards one another in a horizontal plane, so that rows 29 supplied from below can be combined with rows already lifted and can then be deposited on the supporting strips 32.

As soon as several rows 29 (for example, three) have collected above one another in this way, a half-group 33 thus formed is pushed off by a cross-slide 34 from the support formed by the supporting strips 32, in a direction transverse to the feed-conveyor track 25, and onto a platform 35. Because several, namely two half-groups 33 are delivered and deposited on the platform 35, the complete group 23 consisting of two half-groups 33 located next to one another is formed on this platform. For this purpose, the cross-slide 34 executes pushing movements differing in extent.

The platform 35 can likewise be lifted and lowered (by means of a pressure-medium cylinder 36). The group 23 is lifted by means of the platform 35 to the height indicated by dot-and-dash lines in FIGS. 3 and 4. Here, the carton 10 is kept ready in an open position corresponding to FIG. 1*a*. The group 23 is introduced into the carton 10 from below, in such a way that in the upper position of the platform 35 the group 23 assumes the relative position corresponding to the finished carton. Accordingly, the inner tabs and outer tabs extend above and below the group 23.

The apparatus illustrated here is designed as a "semi-automatic machine". The cartons 10 are extracted in a flat position by hand from a magazine 37. An attendant stands, in the region of a recess 38, directly adjacent to a carton station identified by the platform 35. The cartons 10 set up manually are placed by means of the lower outer tabs 21 and 22 on a mounting which consists of lateral, essentially U-shaped supporting rails 39 and 40 (FIG. 4). The outer tabs 21 and 22 are inserted into the supporting rails 39 and 40 by being bent open slightly (shaped outwards) in the form of a funnel, as a result of which a sufficiently stable support for the open carton 10 is provided. The pack content (group 23) can now be introduced into the carton from below without any difficulties.

In the present exemplary embodiment, the platform 35 is designed, in the region of the lower (initially rear) inner tab 18, with an obliquely directed leg 41. When the group 23 is introduced into the carton 10, this leg grasps the inner tab 18 and folds it into a position pointing obliquely outwards or rearwards (FIG. 3).

The (open) carton 10 is now pushed off, together with its contents (group 23), from the platform 35 along a first conveying stage 42 represented by an arrow, and is deposited on a table 43 situated essentially at the same height. At the same time, the outer tabs 21 and 22 extending in a longitudinal direction slide out of the open supporting rails 39 and 40. During this first conveying stage 42, the upper and lower inner tabs 15, 16 located at the front in the direction of transport are folded over. Pushing-off is effected by means of a slide 44 which is movable to and fro and the end position of which, in the region of the table 43, is shown by dot-and-dash lines in FIG. 2.

Formed in the region between the platform 35 and the table 43 is a fixed folding bridge 45 which serves at the same time as a lower support for the carton 10 in the region of the conveying stage 42. The folding bridge 45 designed as a fixed wall is provided, on the side facing the platform 35, with an oblique run-on surface 46. As a result of the movement over the folding bridge 45, the lower inner tab 17 located at the front in the direction of movement is folded against the underside of the group 23 and consequently into the plane of the lower wall 14. The carton 10 is therefore pushed onto the table 43 with the inner tab 17 already folded over.

The carton 10, together with its contents, is transported from the platform 35 onto the table 43 by means of a special conveyor unit 47 which is located above the path of movement of the carton 10 on a common machine frame 48. The reciprocating conveying means is a driver 49 which grasps the carton 10 at the rear. The driver 49 is mounted so as to slide on (two) supporting rods 50 by means of a slide 51. The latter is driven in turn by means of a chain drive 52 consisting of a chain 55 revolving via gear wheels 53 and 54 and of a drive motor 56 which is attached to (the outside of) the machine frame 48 and which drives the gear wheel 57 in a constant direction of movement. Fastened to the chain 55 is an engaging pin 57 which penetrates into a transverse slit-like recess 58 in the slide 51. During the revolving movement of the chain 58, the engaging pin 57 executes, in the region of revolution (gearwheels 53, 54), a to-and-fro movement in the recess 58. The slide 51 and consequently the driver 59 are driven to and fro in this way. The end position facing the table 43 is indicated by dot-and-dash lines in FIG. 3. As a result of this conveyor unit 47, the movement characteristics are especially efficient because of the gradual acceleration and deceleration.

When the carton 10 arrives in the end position on the table 43 (shown by dot-and-dash lines in FIG. 3), the upper inner tab 15 located at the front in the direction of transport is (also) folded over, specifically by means of an upper folder attached to the table 43. In the exemplary embodiment illustrated, this consists of two folding webs 59 and 60 which are arranged at a distance from one another, that is to say are attached to the table 43 laterally, and which are connected via a vertical supporting arm 61 to one edge of the table 43. The latter, the supporting arms 61 and the folding webs 59 and 60 thus form, in a side view, a U-shaped profile into which the part of the carton 10 located at the front in the direction of transport can be introduced, with the inner tab 15 being folded over.

The lower inner tab 18 located at the rear in the direction of transport, because it rests on the folding bridge 45, is moved into an essentially horizontal transverse position directed away from the carton 10 (FIG. 3). The lower outer tabs 21 and 22 extend laterally beside the table 43 in the original vertical plane. The same applies to the upper outer tabs 19 and 20 and the inner tab 16.

The partially folded carton 10 is rotated on the turntable 43 or by means of this, specifically through 90° in the present case (the position shown by unbroken lines in FIG. 2). Moreover, the direction of further transport of the carton 10 is turned through 90°, in particular directed transversely. Consequently, the second conveying stage 62 which now follows is at an angle of 90° relative to the conveying stage 42.

The carton 10, with the inner tabs 16 and 18 now located at the front in the conveying direction, is pushed off from the table 43, which has previously been rotated in an anti-clockwise direction in relation to FIG. 2, and into or onto an adjoining discharge-conveyor track 63. When the carton enters this discharge-conveyor track 63, the inner tabs 16 and 18, here offset in spatial terms, are folded over, and immediately following this or simultaneously the four outer tabs 19 to 22 are also folded over, during further transport, into the plane of the upper wall 13 and the lower wall 14.

The discharge-conveyor track 63 consists (in the first part) of a lower plate 64 for supporting the carton 10 and an upper plate which extends directly above the carton in the direction of transport. The lower plate 64 is held by a supporting stay 66 which is connected to the machine frame 48 and is arranged essentially in the center underneath the lower plate 64 and which is made thin-walled in the upper part, so that this part of the supporting stay 46 can be accommodated between the lower outer tbs 21 and 22 which are folded over during transport.

On both sides of the lower plate 64 and the upper plate 65, (four) longitudinal girders 67 and 68 extend in the conveying direction at a distance from these and offset upwards and downwards respectively. Because of their arrangement and dimensions, these girders form (laterally next to the lower plate 64 and upper plate 65) an upper and lower lateral guide for the carton. Furthermore, the longitudinal girders 67, 68 serve as holders for fixed immovable folding means for the outer tabs 19 to 20. These are folding switchpoints 69, 70 which consist, in a manner known per se, of wires or round bars and which are designed to converge in the conveying direction according to the cycle of the folding movement for the outer tabs 19 to 22. The upper and lower folders, activated beforehand and intended for the inner tabs 16 and 18, are formed by the upper plate 65 and the lower plate 64, in particular by the run-in edges 71 (upper plate) and 72 (lower plate). Run-in plates 72 and 73 which are funnel-shaped, namely converge in the conveying direction, and which have the effect of a mouthpiece orifice are located in front of these run-in edges, which are arranged offset relative to one another in the direction of transport. Consequently, the inner tabs 16 and 18 are gradually folded over as a result of the transport of the carton 10 relative to the upper plate 65 and the lower plate 64. The folding of the outer tabs 19 to 22 follows as a result of the appropriate shape of the folding switchpoints 69 and 70.

The lower plate 64 ends where the folding over of the lower outer tabs 21 and 22 has been completed. It has adjoining it a base plate 75 (connected to the machine frame 48) as a further transport support for the finished carton 10. The carton lies in the region of the base plate 75 with the lower inner tabs 17 and 18 and the lower outer tabs 21 and 22 folded, that is to say with a completely finished lower wall 14. The transition from the (thin) lower plate 64 to the base plate 75 is designed in a special way. As is evident, especially from FIG. 2, the lower plate 64 is made to taper in the form of a tongue in the conveying direction, that is to say with decreasing cross-sectional dimensions. The base plate 75, which is approximately V-shaped on the side facing the lower plate 64, extends into the region of the lower plate 64 and is also laterally adjacent to this in a part region, specifically to form a gap 81. The bevelled, that is to say tapering cross-sectional design of both the lower plate 64 and the base plate 65 results, here, in a certain "overlap" (FIG. 4) which makes it easier to transfer the carton from the region of the lower plate 64 onto the base plate 75, and the outer tabs 21 and 22 which are located, in the region of the lower plate 64, underneath the latter come to rest on the base plate 75 as a result of this transfer.

The upper plate is made relatively short (FIG. 4). It is followed by a ram plate 76 which is movable up and down and which, to complete the folding of the upper outer tabs 19 and 20, can be lowered onto these and at the same time stabilizes this closing position of the carton.

The inner and outer tabs 19 to 22 resting against one another are provided with glue to produce a durable bond. To apply glue or glue spots, glue-coating means 77 and 78 are located in the region of the conveying stage 62 above and below the path of movement of the carton 10, specifically in such a way that, in the present case, the inner faces of the outer tabs 19 to 22 are provided with glue by means of spray nozzles, specifically as a result of the application of glue strips in the region of the spray nozzles. For this purpose, the triangular glue-coating means 77, 78, together with the spray nozzles, are arranged in the region of obliquely directed legs on the underside of the lower plate 64 and the top side of the upper plate 65, specifically in a region in which the outer tabs 19 to 22 momentarily assume an oblique intermediate position, for example at an angle of 45° position according to FIG. 5). The outer tabs 19 to 22 are directed approximately parallel to the legs of the triangular glue-coating means 77, 78, so that glue can be coated on the inner faces of the outer tabs. In the lowered position, the ram plate 76 causes the upper and lower inner and outer tabs to be pressed together. The ram plate 76 is designed as a narrow rectangle, so that it can be moved between the upper folding switchpoints 69.

The carton 10 is transported in the region of the conveying stage 62, that is to say from the table 43 along the discharge-conveyor track 63, by means of a conveyor unit 79 which is located on a side wall of the machine frame 48 somewhat above the table 43 (FIG. 3). This conveyor unit 79 has approximately the same design as the conveyor unit 47. Identical parts are therefore identified by the same reference numerals. However, in the present case, a driver 49 is connected to the slide 51 by means of a bent supporting arm 80. As a result, the conveyor unit 79 can be located above the path of movement of the carton 10. The driver 49 can be moved through in the region between the folding webs 59 and 60 or the supporting arms 61 of the table 43 and can thereby push off the carton 10.

What is claimed is:

1. A method for closing cartons during transport of said cartons, said cartons consisting of side-walls, and of top and bottom walls formed out of upper interior and exterior flaps and lower interor and exterior flaps, respectively, in which the top and bottom interior and exterior flaps can be folded over from their initial position in the plane of the side-walls to the plane of the top and bottom walls, respectively, comprising the steps of:

(a) folding the top and bottom interior flaps (15, 17) which are forward in the initial direction of transport by movement of the carton relative to fixed, immobile folding devices;

(b) moving the cartons so that what has heretofore been the initial back sides of the cartons relative to the initial direction of transport are now turned to face a second direction of transport;

(c) moving the cartons in said second direction of transport;

(d) folding the remaining top and bottom interior flaps (16, 18) by movement of the cartons relative to fixed, immobile folding devices, in said second direction of transport;

(e) folding the top and bottom exterior flaps (19, 20, 21, 22) by means of further movement of the carton (10), relative to fixed, immobile folding devices, in said second direction of transport.

2. A method according to claim 1, in which the second direction of transport is at an angle of 90° relative to said initial direction of transport, and said step of moving the cartons to cause the initial back sides of the cartons to face said second direction of transport includes moving said initial back sides through an angle of 90° about a vertical axis to thereby cause said initial back sides to face said second direction of transport.

3. An apparatus for closing cartons during transport of said cartons, said cartons consisting of side-walls and of top and bottom walls formed out of upper interior and exterior flaps and lower interor and exterior flaps, respectively, in which the top and bottom interior and exterior flaps can be folded over from their initial position in the plane of the side walls to the plane of the top and bottom walls, respectively, comprising:

means for transporting said cartons in a first direction;

first fixed, immobile folding means (45, 59, 60) for folding over the top and bottom interior flaps which are forward in the first direction of transport, as the cartons move relative to said first fixed, immobile folding means;

means for rotating the cartons so that what has initially been the rear sides of the cartons relative to the first direction of transport are turned to face a second direction of transport;

means for transporting said cartons in said second direction;

second fixed, immobile folding means (71, 72) for folding the top and bottom interior flaps which are now forward in the second direction of transport, as the cartons move relative to said second fixed, immobile folding means.

4. An apparatus as claimed in claim 3, wherein said means for rotating comprises rotatable table (43), and said first fixed, immobile folding means comprises a fixed folding bridge (45) for folding said bottom interior flaps which are forward in said first direction of transport and first top folders (59, 60) formed as part of said rotatable table for folding said top interior tabs which are forward in said first direction of transport.

5. An apparatus as claimed in claim 4, wherein said first top folders comprises two U-shaped folding means connected to a support arm (61).

6. An apparatus as claimed in claim 4, further comprising a vertically movable platform (35) positioned at a first conveying stage (42), said fixed folding bridge being located between said platform (35) and said rotatable table (43) in the first direction of transport.

7. An apparatus as claimed in claim 4, wherein said rotatable table (43) includes means for rotating cartons through an angle of at least 90°, and said means for transporting said cartons in a second direction includes means for transporting the cartons in a direction displaced 90° from the first direction, said second fixed, immobile folding means comprising fixed upper and lower folders (64, 65) with run-in edges (71, 72) forming a portion of a discharge conveyor track (63).

8. An apparatus as claimed in claim 7, further comprising fixed, immobile top and bottom exterior flaps folding means (69, 70) for folding said top and bottom exterior flaps as said cartons move in said second direction along said discharge conveyor track.

9. An apparatus as claimed in claim 8, further comprising glue-coating means (77, 78) for coating the inner faces of the exterior flaps with glue, said glue-coating means being provided on said upper and lower folders (64, 65) of said discharge conveyor track (63).

* * * * *